US010245565B2

(12) United States Patent
Pappalardo

(10) Patent No.: US 10,245,565 B2
(45) Date of Patent: Apr. 2, 2019

(54) DOUBLE WALL FLOW SHIFTER BAFFLES AND ASSOCIATED STATIC MIXER AND METHODS OF MIXING

(71) Applicant: Nordson Corporation, Westlake, OH (US)

(72) Inventor: Matthew E. Pappalardo, Ewing, NJ (US)

(73) Assignee: Nordson Corporation, Westlake, OH (US)

( * ) Notice: Subject to any disclaimer, the term of this patent is extended or adjusted under 35 U.S.C. 154(b) by 259 days.

(21) Appl. No.: 15/074,013

(22) Filed: Mar. 18, 2016

(65) Prior Publication Data

US 2017/0036180 A1 Feb. 9, 2017

Related U.S. Application Data

(60) Provisional application No. 62/202,554, filed on Aug. 7, 2015.

(51) Int. Cl.

| | |
|---|---|
| ***B01F 5/06*** | (2006.01) |
| ***B01F 13/00*** | (2006.01) |
| ***B01F 3/10*** | (2006.01) |

(52) U.S. Cl.

CPC ..... *B01F 5/0606* (2013.01); *B01F 3/10* (2013.01); *B01F 5/0641* (2013.01); *B01F 13/0023* (2013.01); *B01F 2215/0039* (2013.01)

(58) Field of Classification Search

CPC ..... B01F 5/064; B01F 5/0641; B01F 5/0642; B01F 5/0612; B01F 5/0606; B01F 2215/006

(Continued)

(56) References Cited

U.S. PATENT DOCUMENTS 1,648,708 A 11/1927 Wilkinson
3,195,865 A * 7/1965 Harder ..... B01F 5/0641 137/599.01

(Continued)

FOREIGN PATENT DOCUMENTS

CH 699958 A1 5/2010
EP 0749776 A1 12/1996

(Continued)

OTHER PUBLICATIONS

International Patent Application No. PCT/US2016/045281; Int'l Preliminary Report on Patentability; dated Feb. 22, 2018; 8 pages.

(Continued)

*Primary Examiner* — Tony G Soohoo
*Assistant Examiner* — Elizabeth Insler
(74) *Attorney, Agent, or Firm* — Baker & Hostetler LLP

(57) ABSTRACT

A flow shifter baffle for mixing a fluid flow having at least two components, a static mixer and method of mixing. The flow shifter baffle includes a double divider wall element adjacent to a leading edge and a plurality of occluding walls coupled to the double divider wall element. The double divider wall element includes first and second generally parallel walls which extend across the entire transverse flow cross-section. The double divider wall element is configured to divide the fluid flow into a central flow portion and first and second peripheral flow portions. This division of the fluid flow using the double divider wall element and the plurality of occluding walls improves the mixing of separate components by producing a greater number of layers with less jumbling of the layers, when a layered composition of multiple components is delivered into the flow shifter baffle.

15 Claims, 16 Drawing Sheets

(58) Field of Classification Search
USPC ..... 366/336, 337, 340
See application file for complete search history.

(56) References Cited

U.S. PATENT DOCUMENTS

| | | | | |
|---|---|---|---|---|
| 3,239,197 | A | 3/1966 | Tollar | |
| 3,406,947 | A | 10/1968 | Harder et al. | |
| 3,424,437 | A | 1/1969 | Shearer et al. | |
| 4,538,920 | A | 9/1985 | Drake | |
| 5,487,606 | A | 1/1996 | Keller | |
| 5,498,078 | A | 3/1996 | Keller | |
| 5,851,067 | A | 12/1998 | Fleischli et al. | |
| 5,944,419 | A * | 8/1999 | Streiff ..... | B01F 5/0641 366/337 |
| 6,599,008 | B2 | 7/2003 | Heusser et al. | |
| 6,773,156 | B2 | 8/2004 | Henning | |
| 7,325,970 | B2 | 2/2008 | Keller | |
| 7,841,765 | B2 | 11/2010 | Keller | |
| 7,985,020 | B2 | 7/2011 | Pappalardo | |
| 8,083,397 | B2 | 12/2011 | Pappalardo | |
| 9,046,115 | B1 | 6/2015 | England et al. | |
| 2013/0135963 | A1 | 5/2013 | Linne et al. | |

FOREIGN PATENT DOCUMENTS

| | | | |
|---|---|---|---|
| EP | 0815929 | A1 | 1/1998 |
| EP | 1125626 | A1 | 8/2001 |
| EP | 1426099 | A1 | 6/2004 |
| EP | 2133138 | A1 | 12/2009 |
| EP | 2599540 | A1 | 6/2013 |
| EP | 3059006 | A1 | 8/2016 |
| JP | 55145522 | A | 11/1980 |
| WO | 2011162728 | A1 | 12/2011 |

OTHER PUBLICATIONS

International Application No. PCT/US2016/045239: Invitation to Pay Additional Fees dated Nov. 15, 2016, 8 pages.

International Application No. PCT/US2016/045239: International Search Report and The Written Opinion dated Feb. 20, 2017, 19 pages.

International Application No. PCT/US2016/045281: International Search Report and The Written Opinion dated Nov. 15, 2016, 13 pages.

* cited by examiner

DOUBLE WALL FLOW SHIFTER BAFFLES AND ASSOCIATED STATIC MIXER AND METHODS OF MIXING

CROSS REFERENCE TO RELATED APPLICATION

This application claims the priority of U.S. Provisional Patent Application Ser. No. 62/202,554, filed on Aug. 7, 2015, the entire disclosure of which is hereby incorporated by reference herein.

TECHNICAL FIELD

This disclosure generally relates to a fluid dispenser and more particularly, to components of a static mixer and methods of mixing fluid flows.

BACKGROUND

A number of motionless mixer types exist, such as Multiflux, helical and others. These mixer types, for the most part, implement a similar general principle to mix fluids together. In these mixers, fluids are mixed together by dividing and recombining the fluids in an overlapping manner. This action is achieved by forcing the fluid over a series of mixing elements and baffles of alternating geometry. Such division and recombination causes the layers of the fluids being mixed to thin and eventually diffuse past one another, resulting in a generally homogenous mixture of the fluids. This mixing process has proven to be very effective, especially with high viscosity fluids.

Static mixers are typically constructed of a series of mixing elements and alternating baffles, of varying geometries, usually consisting of right-handed and left-handed mixing baffles located in a conduit to perform the continuous division and recombination. Such mixers are generally effective in mixing together most of the mass fluid flow, but these mixers are subject to a streaking phenomenon, which has a tendency to leave streaks of completely unmixed fluid in the extruded mixture. The streaking phenomenon often results from streaks of fluid forming along the interior surfaces of the mixer conduit that pass through the mixer essentially unmixed.

Moreover, there have been previous attempts made to maintain adequate mixer length while trying to address the streaking phenomenon. In one example, the traditional left-handed and right-handed mixing baffles can be combined with flow inversion baffles, such as the specialized inverter baffles described in U.S. Pat. No. 7,985,020 to Pappalardo and U.S. Pat. No. 6,773,156 to Henning. However, these known types of flow inversion baffles may cause a high backpressure within the mixer conduit and may also disrupt the mixing layers of material as a result of the complex movements required for fluid flow through the flow inversion baffles. That disruption of the mixing layers can reduce the efficiency of mixing enabled by the downstream mixing baffles, which means that more elements and length may be required in the static mixer to achieve the desired mixing effects. In this regard, the streaking phenomenon is handled by the flow inversion baffles, but these also present further disadvantages to overcome in the static mixer as a whole.

Therefore, it would be desirable to further enhance the mixing elements used with static mixers of this general type, so that mixing performance is further optimized at each mixing element, and preferably without generating high amounts of backpressure.

SUMMARY

In accordance with one embodiment, a flow shifter baffle is configured to mix a fluid flow having at least two components. The flow shifter baffle includes a leading edge, a trailing edge, a double divider wall element, and a plurality of occluding walls. The flow shifter baffle defines a transverse flow cross-section perpendicular to the fluid flow along an entire length between the leading and trailing edges. The transverse flow cross-section has an outer periphery. The double divider wall element is adjacent to the leading edge. The double divider wall element includes first and second generally parallel walls. The double divider wall element extends across the entire transverse flow cross-section and is configured to divide the fluid flow into a central flow portion and first and second peripheral flow portions. The plurality of occluding walls are coupled to the double divider wall element and are positioned to force movement of the first and second peripheral flow portions. The flow shifter baffle improves the mixing of separate components by producing a greater number of layers with less disruption of the layers, when a layered mixture is delivered into the flow shifter baffle.

In various embodiments, the flow shifter baffle further includes a dividing panel adjacent to the trailing edge. The dividing panel is coupled to the double divider wall element, and includes first and second sides facing opposite directions. The first and second sides are oriented transverse from the first and second generally parallel walls. The plurality of occluding walls force the first peripheral flow portion to flow along the first side of the dividing panel and the second peripheral flow portion to flow along the second side of the dividing panel, thereby shifting the central flow portion towards an outer periphery of the flow shifter baffle as the first and second peripheral flow portions flow along the first and second sides of the dividing pane respectively.

In various embodiments, the plurality of occluding walls shift an entirety of the first and second peripheral flow portions to a different portion of the flow cross-section. In some embodiments, the double divider wall element includes a first central occluding wall surface and a second central occluding wall surface. The first and second central occluding wall surfaces may be arranged such that first and second central occluding wall surfaces do not overlap, revealing an opening along the transverse flow cross-section for the central flow portion to move through unimpeded. In other embodiments, the double divider wall element includes a central X-shaped structure extending between the first and second parallel walls. The central X-shaped structure includes first and second angled walls. The first angled wall extends from the first parallel wall at the leading edge to a back end of the second parallel wall, and the second angled wall extends from the second parallel wall at the leading edge to a back end of the first parallel wall. Yet in other embodiments, there are no walls or other structure extending between the first and second parallel walls, such that the central flow portion does not shift between the first and second parallel walls.

In accordance with yet another aspect of the present invention, a static mixer for mixing a fluid flow having at least two components is described. The static mixer includes a mixer conduit configured to receive the fluid flow and a mixing component. The mixing component is defined by a plurality of mixing elements positioned in the mixer conduit, the plurality of mixing elements including at least one flow shifter baffle, as described above.

In accordance with yet another aspect of the present invention, a method of mixing at least two components of a fluid flow with a static mixer is described. The static mixer includes a mixer conduit and a plurality of mixing baffles including at least one flow shifter baffle. The method includes introducing the fluid flow having at least two components into an inlet end of the mixer conduit. The method further includes forcing the fluid flow through the plurality of mixing baffles to produce a mixed fluid flow, which includes forcing the fluid flow through the at least one flow shifter baffle. The method also includes dividing the fluid flow with a double divider wall element into a central flow portion and first and second peripheral flow portions. The method further includes shifting the first and second peripheral flow portions around a transverse flow cross-section through the flow shifter baffle with a plurality of occluding walls, and shifting the central flow portion with the flow of the first and second peripheral flow portions towards an outer periphery of the transverse flow cross-section of the at least one flow shifter baffle. This method results in doubling a number of flow layers of the at least two components as a result of flow through the at least one flow shifter baffle, while maintaining a general orientation of the flow layers as the fluid flow moves through the at least one flow shifter baffle.

These and other objects and advantages of the disclosed apparatus will become more readily apparent during the following detailed description taken in conjunction with the drawings herein.

DETAILED DESCRIPTION

Figure 1:
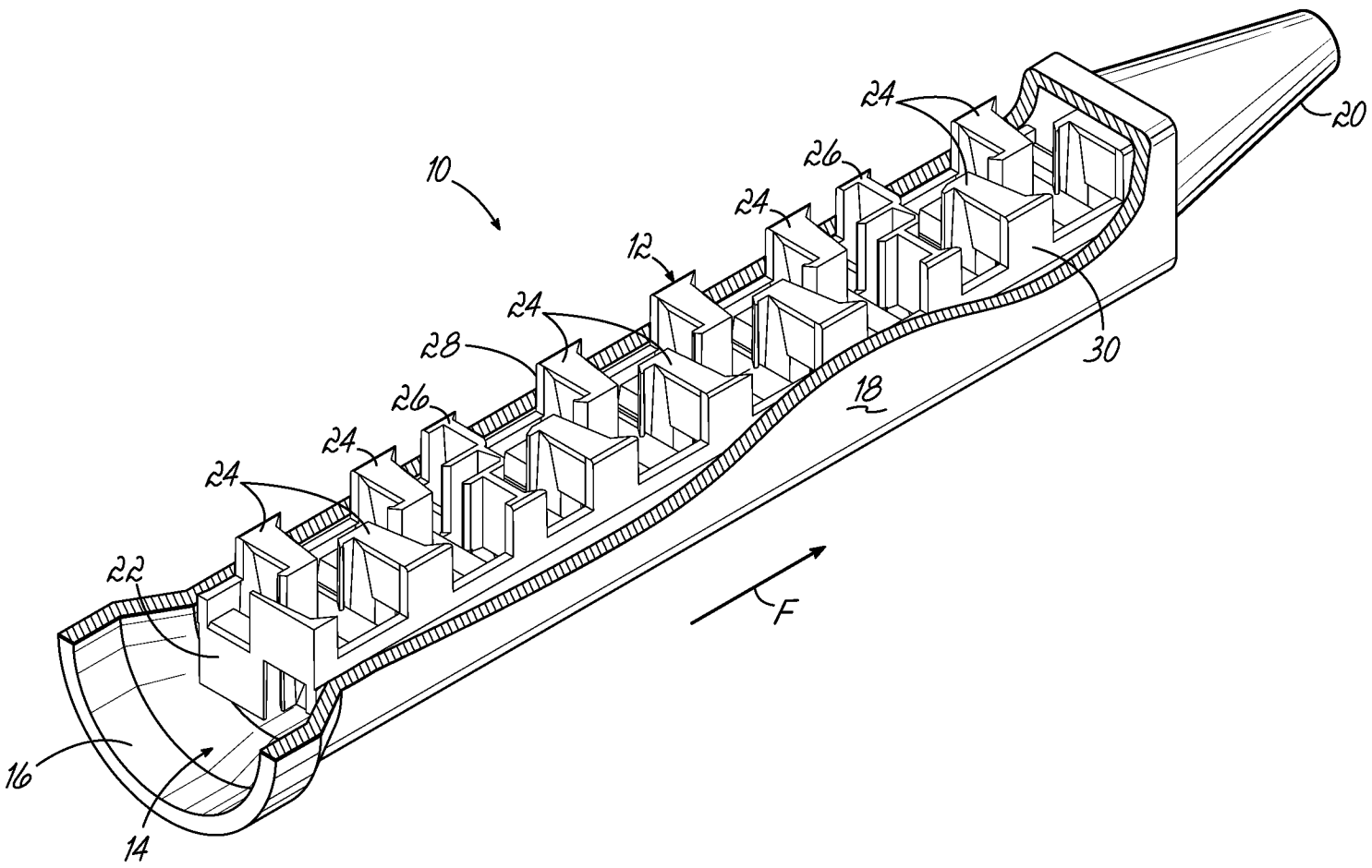
FIG. 1 is a front perspective view of a static mixer in accordance with one embodiment of the invention.
Figure 2:
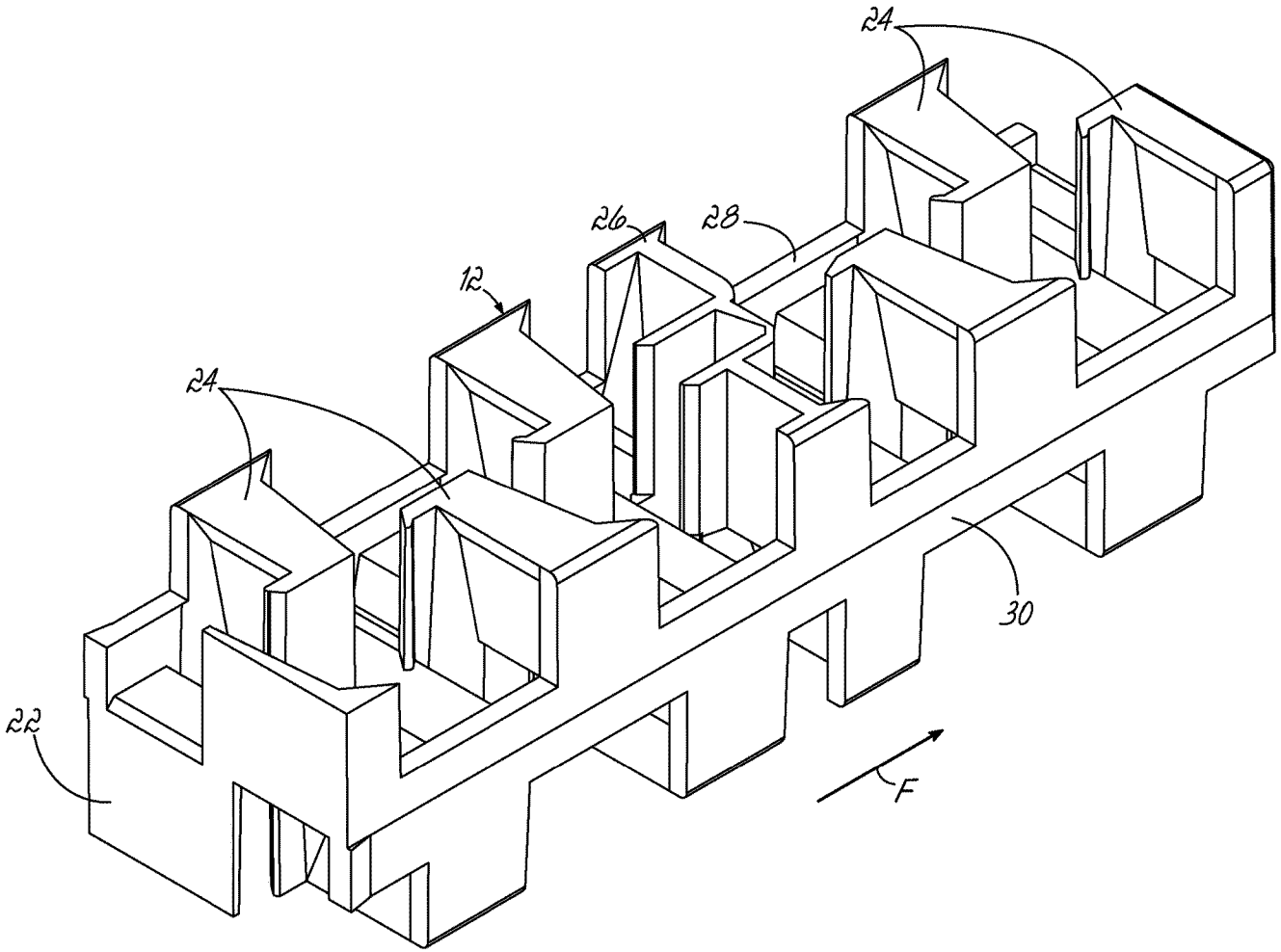
FIG. 2 is a front perspective view of a portion of a mixing component of the static mixer of FIG. 1.

Referring generally to FIGS. 1 and 2, one embodiment of a static mixer 10 according to an exemplary embodiment of the invention is shown. The static mixer 10 includes a mixing component 12 having a series of mixing elements and baffles for dividing, shifting, and recombining a fluid flow F in various manners along a length of the static mixer 10. These various mixing elements and baffles function together to thoroughly mix multiple components of the fluid flow, and thereby minimize streaks of unmixed fluid components in the extruded fluid mixture. The function, benefits, and structural features of each of the types of mixing elements and baffles are described in turn below in connection with respective Figures.

The static mixer 10 generally includes a conduit 14 and the mixing component 12 inserted into the conduit 14. The conduit 14 defines an inlet end socket 16 configured to be attached to a cartridge, cartridge system, or metering system (none of which are shown) containing at least two fluids to be mixed together. For example, the inlet end socket 16 may be connected to any of the two-component cartridge systems available from Nordson Corporation. The conduit 14 also includes a body section 18 shaped to receive the mixing component 12 and a nozzle outlet 20 communicating with the body section 18. Although the body section 18 and mixing component 12 are shown as having substantially square cross-sectional profiles, those skilled in the art will appreciate that the concepts described below may equally apply to mixers with other geometries, including round or cylindrical as well as others.

The series of mixing elements and baffles of the mixing component 12 begins with an entry mixing element 22 adjacent to the inlet end socket 16 and which is configured to ensure some initial division and mixing of the at least two fluids received in the static mixer 10 regardless of the orientation of the mixing component 12 relative to the incoming fluid flows. Downstream of the entry mixing element 22 is a series of left-handed and right-handed versions (labeled $\mathbf{24}_L$ and $\mathbf{24}_R$ below) of a double wedge mixing baffle 24. Each double wedge mixing baffle 24 functions to divide the fluid flow at a leading edge of the mixing baffle 24, and then shift or rotate the flow clockwise or counterclockwise through a partial rotation before expanding and recombining the fluid flow at a trailing edge of the mixing baffle 24. A flow shifter element 26 is interjected after every set of several double wedge mixing baffles 24 in the series. The flow shifter element 26 is configured to shift at least a portion of the fluid flow from one side of the conduit 14 to another side of the conduit 14, thereby providing a different type of fluid movement and mixing contrasting with the double wedge mixing baffles 24. Each of these types of mixing elements and baffles is described in greater detail below in connection with respective Figures.

FIG. 2 shows a partial portion of the mixing component 12, separated from the remainder of the static mixer 10. It will be understood that one or more of the elements defining the mixing component 12 may be reorganized or modified from those shown without departing from the scope of this disclosure, provided that the mixing component 12 includes one or more mixing baffles, and one or more of the flow shifter elements 26.

The series of mixing elements and baffles 22, 24, 26 defining the mixing component 12 are integrally molded with one another so as to define first and second sidewalls 28, 30. The first and second sidewalls 28, 30 at least partially bound opposite sides of the mixing component 12, whereas the other sides of the mixing component 12 extending between the first and second sidewalls 28, 30 remain largely open or exposed to an associated interior surface 32 of the conduit 14 (one of the interior surfaces 32 is cut away and not shown in FIG. 1). The total number of mixing elements and baffles 22, 24, 26 may vary in different embodiments of the mixer 10. Thus, although the particular structures of the mixing elements and baffles 22, 24, 26 shown in FIG. 1 will be described in greater detail below, it will be understood that the static mixer 10 is merely one example of an embodiment incorporating aspects of the present disclosure.

Now with reference to FIGS. 3 through 20, several exemplary embodiments of the flow shifter element 26 (also referred to as a flow shifter baffle) are shown in further detail. Each of these flow shifter elements 26 is configured to remove a streak from a fluid bypass zone, typically located in the periphery of the mixer conduit, and moves this streak towards the center of the mixer conduit where the streak can be divided and mixed thoroughly by further elements like the double wedge mixing baffles 24 located downstream from the flow shifter element 26. Furthermore, the movement of the fluid flow caused by the flow shifter elements 26 is designed to limit additional backpressure caused by flowing through the static mixer 10, while also enabling for layers of fluid flow, which have been created by the mixing baffles 24 upstream from the flow shifter element 26, to remain intact and in the same general orientation for further mixing by the mixing baffles 24 located downstream from the flow shifter element 26. To this end, the flow shifter elements 26 of the various embodiments described below shuffle or shift a critical portion of the fluid flow while allowing the remainder of the fluid flow to pass through without significant jumbling or other detrimental effects, thereby also limiting added backpressure caused by flowing through the flow shifter element 26.

Turning to the embodiment shown in FIGS. 3 through 7, a first embodiment of the flow shifter baffle 210 is shown in further detail. The flow shifter baffle 210 is generally square-shaped in these Figures and therefore would be configured for use in a square mixer conduit, but it will be understood that the flow shifter baffle 210 may define different cross sectional shapes in other similar embodiments. The flow shifter baffle 210 includes a leading edge 212 facing an upstream direction relative to fluid flow when placed in the static mixer 10 and an opposite trailing edge 214 facing a downstream direction. The leading edge 212 is at least partially defined by a double divider wall element 216 which extends back towards a central portion of the flow shifter baffle 210. The double divider wall element 216 is described in further detail below, but it is primarily defined by first and second generally parallel walls 218, 220 shown in a generally vertical orientation in these Figures. The trailing edge 214 is at least partially defined by a dividing panel 222 which is coupled to the double divider wall element 216 adjacent the central portion of the flow shifter baffle 210. The flow shifter baffle 210 defines a transverse flow cross-section perpendicular to the fluid flow F along an entire length between the leading and trailing edges 212, 214, with the transverse flow cross-section having an outer periphery. The dividing panel 222 is oriented generally transverse (such as perpendicular) to the first and second generally parallel walls 218, 220, as shown by the horizontal orientation as presented in the Figures. The dividing panel 222 includes a first side 224 and a second side 226 facing opposite directions and extending to the trailing edge 214. Additionally, the flow shifter baffle 210 further includes a plurality of occluding walls 228, 230, 232, 234 that are coupled to the double divider wall element 216 so as to extend transverse to the fluid flow direction through the static mixer 10. This combination of walls and elements and their associated functionalities are described in further detail below, but it will be understood that more or fewer elements may be included in the flow shifter baffle 210 in accordance with other embodiments.

Figure 3:
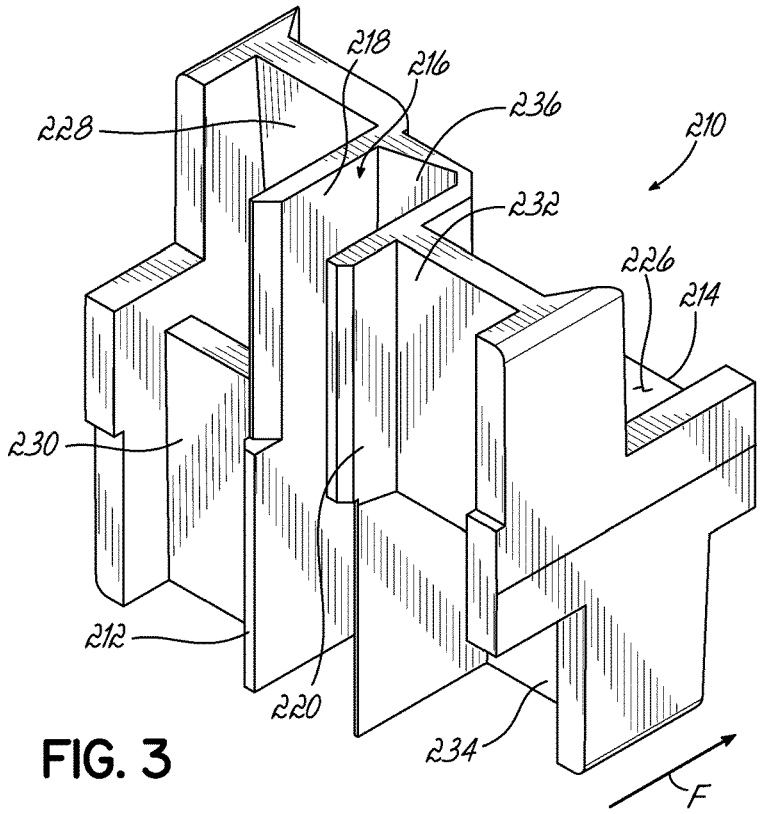
FIG. 3 is a front perspective view of a flow shifter baffle in accordance with one embodiment.
Figure 4:
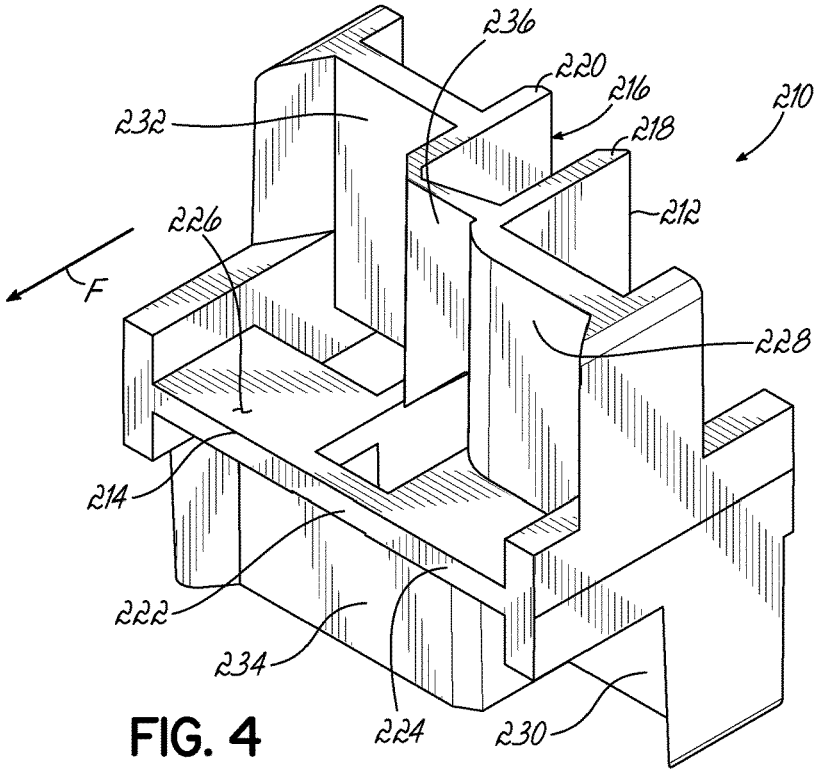
FIG. 4 is a rear perspective view of the flow shifter baffle of FIG. 3.
Figure 5:
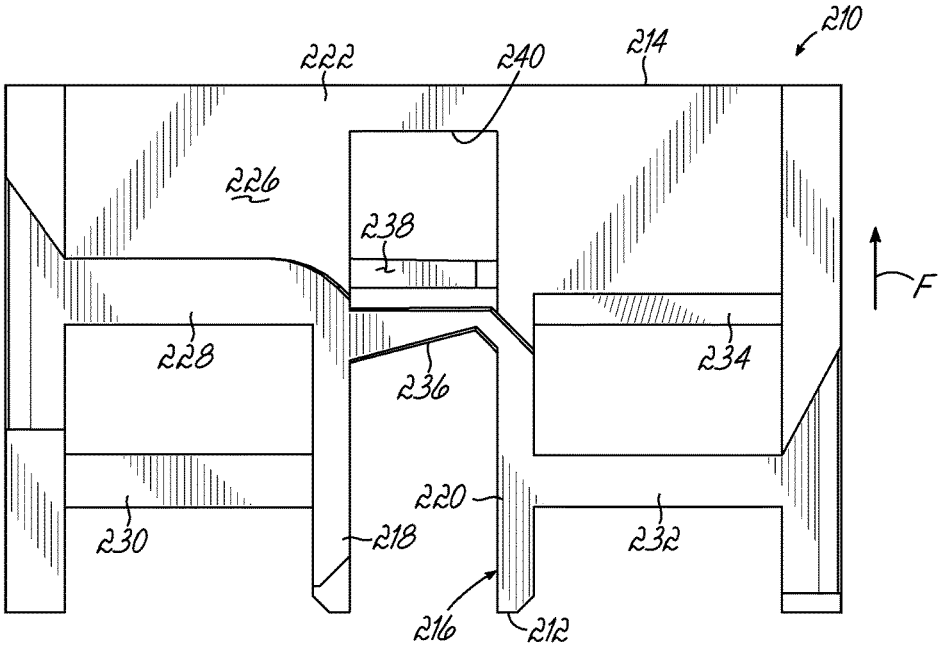
FIG. 5 is a top view of the flow shifter baffle of FIG. 3.

As shown most clearly in FIGS. 3 and 5, the fluid flow (indicated by arrow F) first encounters the parallel walls 218, 220 at the leading edge 212 of the flow shifter baffle 210. The parallel walls 218, 220 may optionally include tapered or sharpened ends at the leading edge 212 as shown to help reduce additional backpressure and guide the fluid flow into spaces around the double divider wall element 216. The parallel walls 218, 220 divide the incoming fluid flow into three portions: a central flow portion located between the parallel walls, a first peripheral flow portion located on an opposite side of the first parallel wall 218, and a second peripheral flow portion located on an opposite side of the second parallel wall 220. These flow portions are typically not recombined in any manner until reaching the dividing panel 222. As will be described below, the central flow portion largely moves through the flow shifter baffle 210 with minimum shifting before recombination with the other flow portions, while the first and second peripheral flow portions are forced to shift by the occluding walls 228, 230, 232, 234. As shown, the plurality of occluding walls 228, 230, 232, 234 shift the entire flow section located outside the double divider wall element 216 so as to shift the entirety of the first and second peripheral flow portions to a different portion of the flow cross-section.

Figure 6:
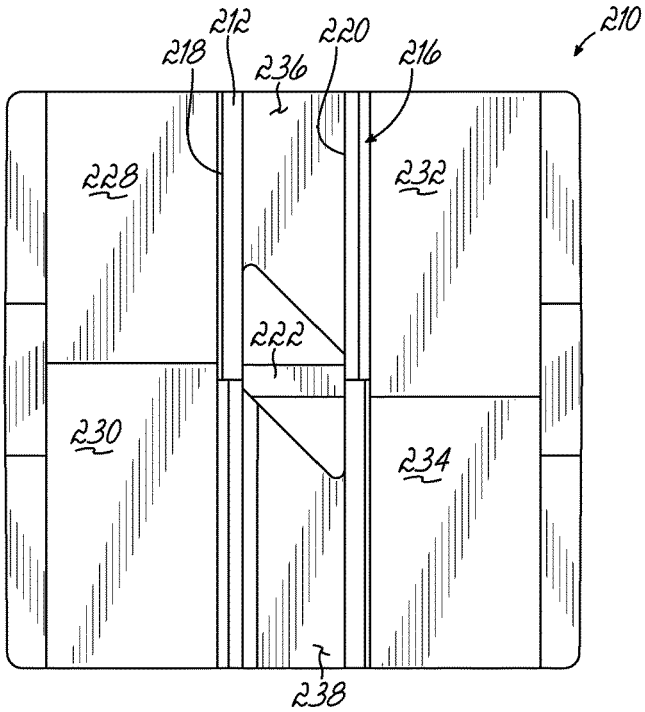
FIG. 6 is a front elevational view of the flow shifter baffle of FIG. 3.
Figure 7:
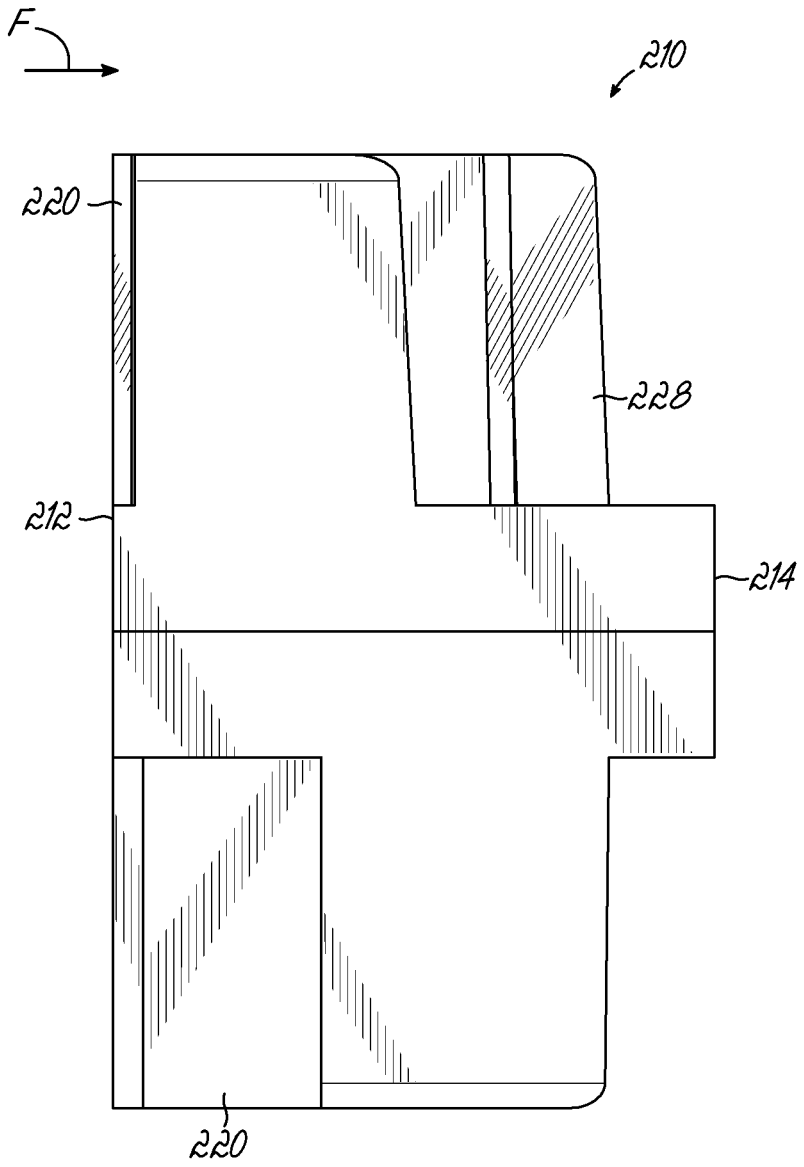
FIG. 7 is a side elevational view of the flow shifter baffle of FIG. 3.
Figure 8:
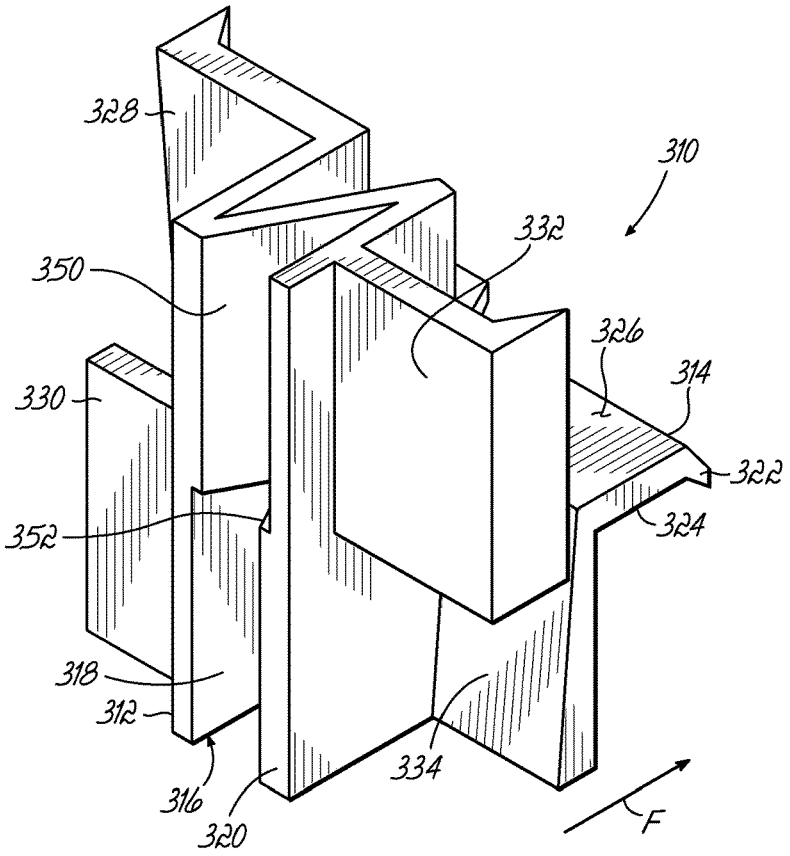
FIG. 8 is a front perspective view of a flow shifter baffle in accordance with an alternative embodiment, which specifically includes an X-shaped structure at a double divider wall element.
Figure 9:
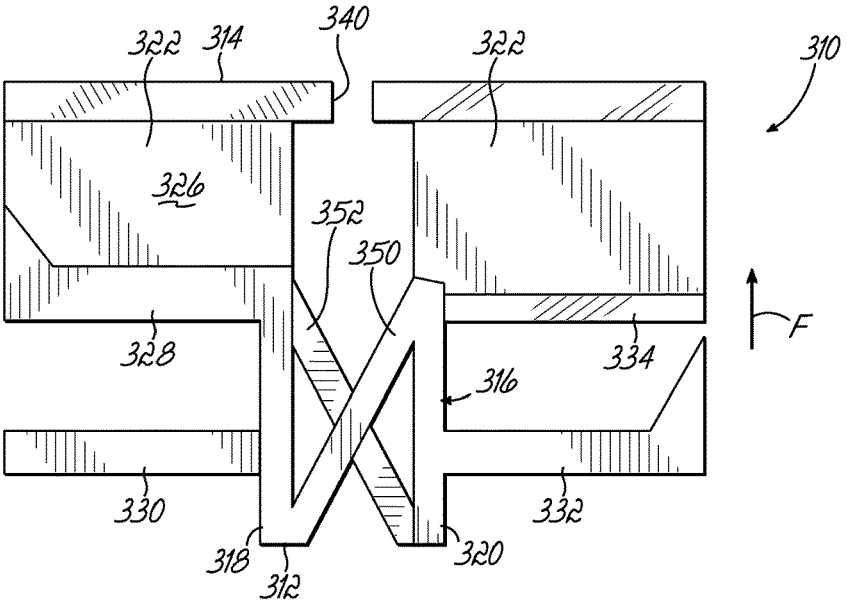
FIG. 9 is a top view of the flow shifter baffle of FIG. 8.
Figure 10:
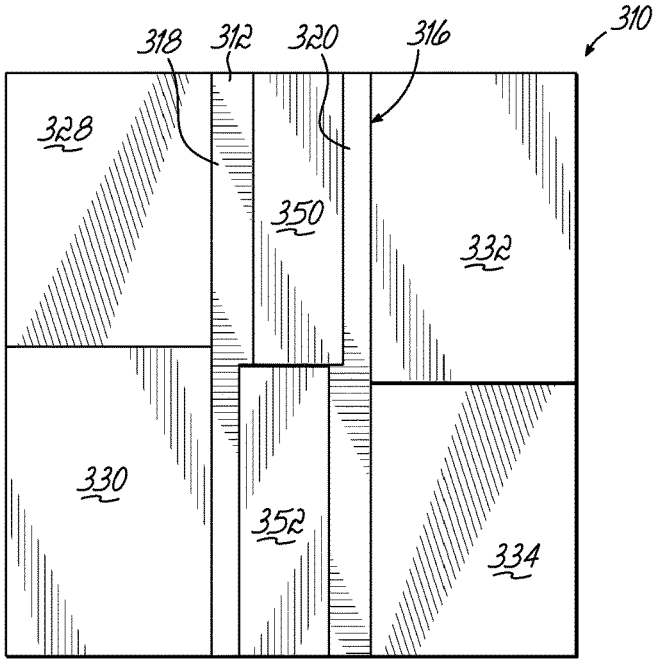
FIG. 10 is a front elevational view of the flow shifter baffle of FIG. 8.
Figure 11:
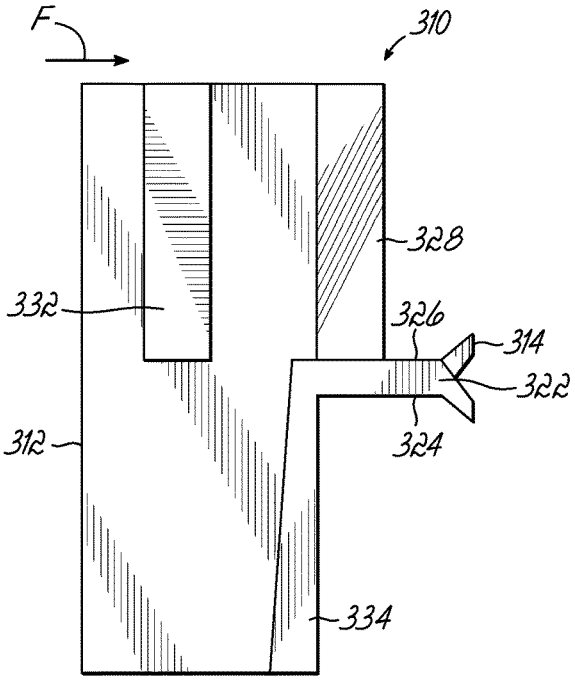
FIG. 11 is a side elevational view of the flow shifter baffle of FIG. 8.
Figure 12:
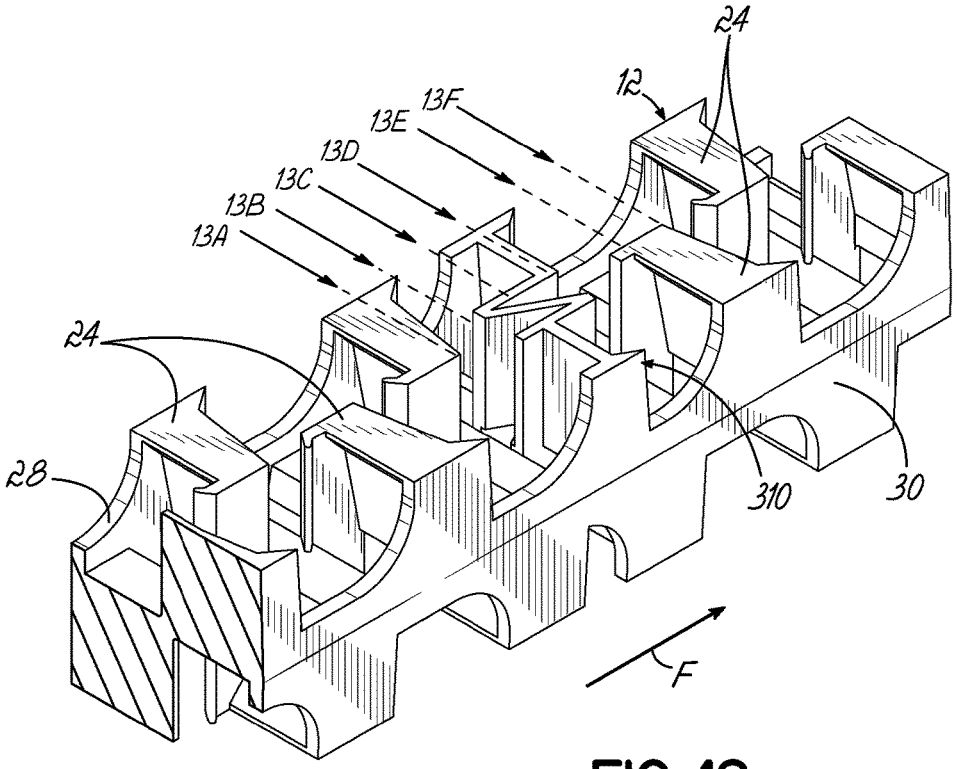
FIG. 12 is a front perspective view of a stack of mixing baffle elements including the flow shifter baffle of FIG. 8, with various flow cross sections indicated.

With reference to FIGS. 5 and 6, the flow path for the first and second peripheral flow portions is shown in further detail. As evident from the front view of FIG. 6, the entire flow path through these portions of the flow shifter baffle 210 are blocked at some point by the first, second, third, and fourth occluding walls 228, 230, 232, 234, which are effectively located in the four different quadrants defined along the length of the static mixer 10. More specifically, the first peripheral flow portion first encounters and must flow past the second occluding wall 230 located on a lower left quadrant in the view shown in FIG. 6. After flowing over this second occluding wall 230, the first peripheral flow portion then encounters the first occluding wall 228 located in an upper left quadrant in the view shown in FIG. 6. This first occluding wall 228 forces the first peripheral flow portion to shift downwardly such that the first peripheral flow portion then flows along the first side 224 (bottom side) of the dividing panel 222. Because the first peripheral flow portion is shifted upwardly, downwardly, and to the right without bending or curving around corners, the general orientation of any flow layers entering this portion of the flow shifter baffle 210 is maintained during flow through this baffle 210.

Similarly, the second peripheral flow portion first encounters and must flow past the third occluding wall 232 located on an upper right quadrant in the view shown in FIG. 6. After flowing under this third occluding wall 232, the second peripheral flow portion then encounters the fourth occluding wall 234 located in a lower right quadrant in the view shown in FIG. 6. This fourth occluding wall 234 forces the second peripheral flow portion to shift upwardly so as to then flow along the second side 226 (top side) of the dividing panel 222. Because the second peripheral flow portion is shifted downwardly, upwardly, and to the left without bending or curving around corners, the general orientation of any flow layers entering this portion of the flow shifter baffle 210 is maintained.

As briefly described above, the central flow portion is largely passed through to the location adjacent the dividing panel 222 as it flows through the flow shifter baffle 210. In this embodiment of the flow shifter baffle 210, first and second central occluding wall surfaces 236, 238 are positioned to encounter the central flow portion. The first central occluding wall surface 236 is located along an upper portion of the space between the first and second parallel walls 218, 220. This first central occluding wall surface 236 may be angled with respect to a plane transverse to the flow direction, as shown in the view of FIG. 5, in some embodiments, and the central flow portion must first flow under this first central occluding wall surface 236. Then, approximately concurrently with when the first and second peripheral flow portions begin to flow along the dividing panel 222, the central flow portion encounters the second central occluding wall surface 238 and must flow over this element. As shown in the front view of FIG. 6, these first and second central occluding wall surfaces 236, 238 do not overlap, which reveals an "opening" through the length of the flow shifter baffle 210 for the central flow portion to move through largely unimpeded. The second central occluding wall surface 238 is shown as being formed as part of the occluding wall 234 in FIG. 4, but it will be understood that this element may be separately provided or relocated in other embodiments of the baffle 210. Adjacent to the second central occluding wall surface 238, the dividing panel 222 includes an opening 240 extending between the first and second sides 224, 226 in this embodiment. This opening 240 (and others like it provided in the various baffle elements of the static mixer 10) enables pressure equalization across the area of the flow shifter baffle 210 as well as ensured free flow of the central flow portion to the desired location for rejoining the first and second peripheral flow portions.

Therefore, the central flow portion is also shifted upwardly and downwardly in this embodiment before flowing to the opposite first and second sides 224, 226 of the dividing panel 222. The first peripheral flow portion expands or flows to the right along the first side 224 of the dividing panel 222 after passing the occluding wall 228, and it will be readily understood that this flow then encounters or rejoins the part of the central flow portion located under the first side 224 of the dividing panel 222. The continued flow of the first peripheral flow portion forces this part of the central flow portion to move rightwardly or outwardly towards an outer periphery of the flow shifter baffle 210 and of the static mixer 10. Therefore, any flow streak that may be located in this central region is forced outwardly towards a periphery, where flow division and mixing is assured when flowing through subsequent mixing baffles located downstream from the flow shifter baffle 210.

Likewise, the second peripheral flow portion expands or flows to the left along the second side 226 of the dividing panel 222 after passing the occluding wall 234, and it will be readily understood that this flow then encounters or rejoins the part of the central flow portion located above the second side 226 of the dividing panel 222. The continued flow of the second peripheral flow portion forces this part of the central flow portion to move leftwardly or outwardly towards an outer periphery of the flow shifter baffle 210 and of the static mixer 10. This provides the same advantageous benefit for mixing as described above for the other part of the central flow portion. The flow on both sides 224, 226 of the dividing panel 222 is then rejoined at the trailing edge 214 as the fluid flow moves into the next mixing baffle element located in the static mixer 10.

Therefore, the flow shifter baffle 210 of this embodiment divides a central flow portion from peripheral flow portions (this can divide flow layers in the fluid flow so as to double the number of flow layers, as described with reference to schematics below), and then moves or shifts these flow portions such that the orientation of any flow layers is not disturbed or jumbled by the shifting, but any potential flow streaks are moved to an different areas of the static mixer 10 for further mixing at subsequent elements. Because the flow shifter baffle 210 minimizes the shifting movement applied to each flow portion, the added backpressure caused by flowing through the flow shifter baffle 210 is reduced compared to conventional flow inverter designs. Thus, the flow shifter baffle 210 more efficiently handles the flow streaking phenomenon while avoiding a need to dramatically increase the length and/or the backpressure generated within the static mixer 10. Furthermore, it will be appreciated that this embodiment of the flow shifter baffle 210 can be used with any type of other mixing baffle elements to achieve these functional benefits in the use of a static mixer 10, and this is not limited to the double wedge mixing baffles described in further detail above.

With reference to FIGS. 8 through 13F, another embodiment of a flow shifter baffle 310 in accordance with this invention is shown in detail. This flow shifter baffle 310 includes many of the same elements as the previously described embodiment (flow shifter baffle 210), and these elements have been provided with similar reference numbers in the 300 series where the elements are substantially similar or identical. For example, the flow shifter baffle 310 of this embodiment again includes a leading edge 312, a trailing edge 314, a double divider wall element 316 defined by first and second parallel walls 318, 320, a dividing panel 322 with first and second sides 324, 326, and a plurality of occluding walls 328, 330, 332, 334. Although many of these elements have slightly modified shapes or profiles in this embodiment, the flow shifter baffle 310 and its elements function as described above except where the differences are outlined in further detail below (the detailed description of these identical or substantially similar elements is largely not repeated herein for the sake of brevity). Therefore, much like the previous embodiment, the flow shifter baffle 310 moves any flow streaks away from a central portion of the static mixer 10 while also doubling and maintaining the general orientation of flow layers so that the layers are not jumbled or mixed together in a detrimental manner, and also with minimized additional backpressure caused by flow through the flow shifter baffle 310.

In this embodiment of the flow shifter baffle 310, the dividing panel 222 is split into two portions by the opening 340, which extends in this embodiment all the way through the trailing edge 314. This opening 340 is still provided for pressure equalization and for enabling mostly free flow of the central flow portion through the baffle 310. The trailing edge 314 includes fins or tapering so as to guide the fluid flow into the next mixing baffle element when flowing through the static mixer 10. As previously described above, it will be understood that this tapering or sharpening may be applied to elements along the leading edge 312 as well (as was shown in the first embodiment of the flow shifter baffle 210) or not at all in similar embodiments.

The other primary distinction for this embodiment of the flow shifter baffle 310 is the structure which encounters the central flow portion after the fluid flow is divided into the central flow portion and first and second peripheral flow portions by the double divider wall element 316. To this end, the flow shifter baffle 310 further includes a central X-shaped structure (when viewed from the top as in FIG. 9) extending between the first and second parallel walls 318, 320. This central X-shaped structure includes a first angled wall 350 extending from the first parallel wall 318 at the leading edge 312 to a back end of the second parallel wall 320, and a second angled wall 352 extending from the second parallel wall 320 at the leading edge 312 to a back end of the first parallel wall 318. As most readily seen in the front view of FIG. 10, the first angled wall 350 is located at a top half or top portion of the flow shifter baffle 310, while the second angled wall 352 is located at a bottom half or bottom portion of the flow shifter baffle 310. Therefore, these first and second angled walls 350, 352 are each configured to shift one part of the central flow portion. After this shifting of the parts of the central flow portion, the central flow portion is recombined with the shifting first and second peripheral flow portions moving along the first and second sides 224, 226 of the dividing panel 222, similar to the shifting described above.

Figure 13A:
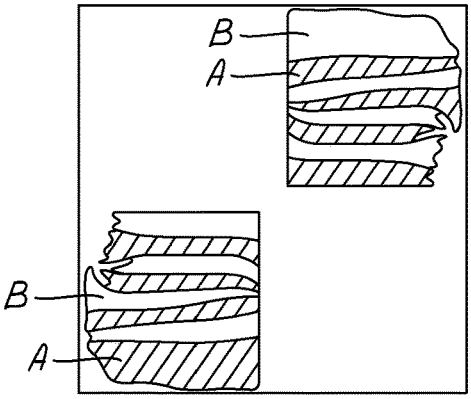
FIG. 13A is a flow cross section taken at line 13A shown in the view of FIG. 12.
Figure 13B:
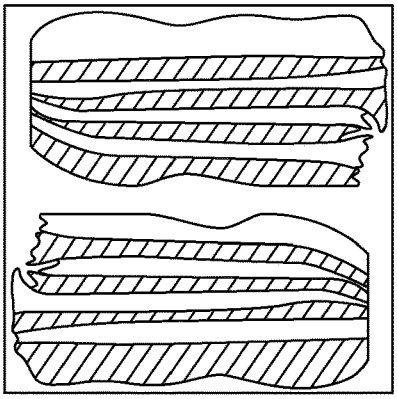
FIG. 13B is a flow cross section taken at line 13B shown in the view of FIG. 12.
Figure 13C:
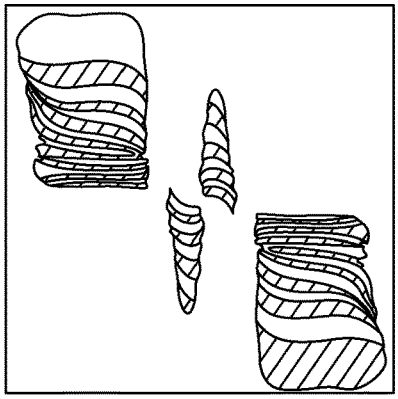
FIG. 13D is a flow cross section taken at line 13D shown in the view of FIG. 12.
FIG. 13E is a flow cross section taken at line 13E shown in the view of FIG. 12.
FIG. 13F is a flow cross section taken at line 13F shown in the view of FIG. 12.

FIGS. 12 and 13A through 13F schematically show a series of flow cross sections taken for a sample fluid flow having two components as evidenced by testing of the flow shifter baffle 310 of this embodiment and its associated static mixer 10. The specific locations of the flow cross sections relative to the flow shifter baffle 310 and the mixing baffles located immediately upstream and downstream from the flow shifter baffle 310 are indicated for clarity in FIG. 12. To this end, the flow is first shown in FIG. 13A while being shifted into two quadrants of the static mixer 10 by the double wedge mixing baffle located immediately upstream (in the fluid flow direction) from the flow shifter baffle 310. The fluid flow is defined by a number of layers of the two types of fluid, shown schematically by the different shading (A) or non-shading (B). FIG. 13B shows the fluid flow immediately before entry at the leading edge 312 of the flow shifter baffle 310, and it will be understood that the flow from each of the quadrants has spread or shifted to fill the space across the width of the static mixer 10.

Figure 13D:
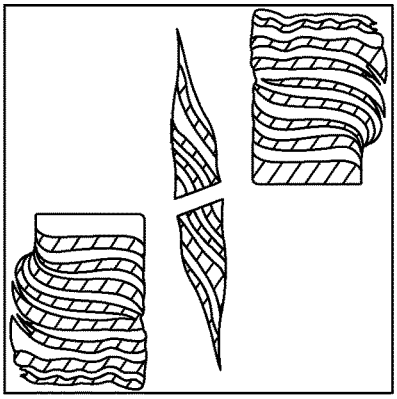

After division by the double divider wall element 316, the fluid flow is shown in FIG. 13B passing through an initial portion of the flow shifter baffle 310. In this regard, the first peripheral flow portion (which includes parts of both flow portions shown in FIG. 13B) has been shifted upwardly by the occluding wall 330 and the second peripheral flow portion has been shifted downwardly by the occluding wall 332. The central flow portion at the top half is being shifted by the first angled wall 350 to begin moving to the right and downwardly, while the central flow portion at the bottom half is being shifted by the second angled wall 352 to begin moving to the left and upwardly. Near the exit of the double divider wall element 316 as shown in FIG. 13D, the top half of the central flow portion has been shifted to the bottom half and the bottom half of the central flow portion has been shifted to the top half, with minimal disruption or jumbling of the flow layers. Likewise, the first peripheral flow portion has been shifted downwardly by the occluding wall 328 while the second peripheral flow portion has been shifted upwardly by the occluding wall 334.

Figure 13E:
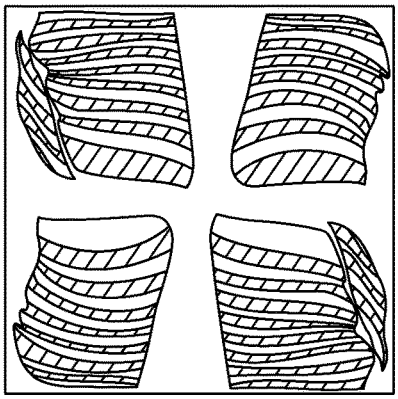
Figure 13F:
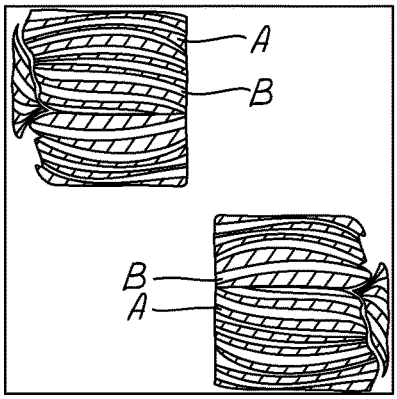
Figure 14:
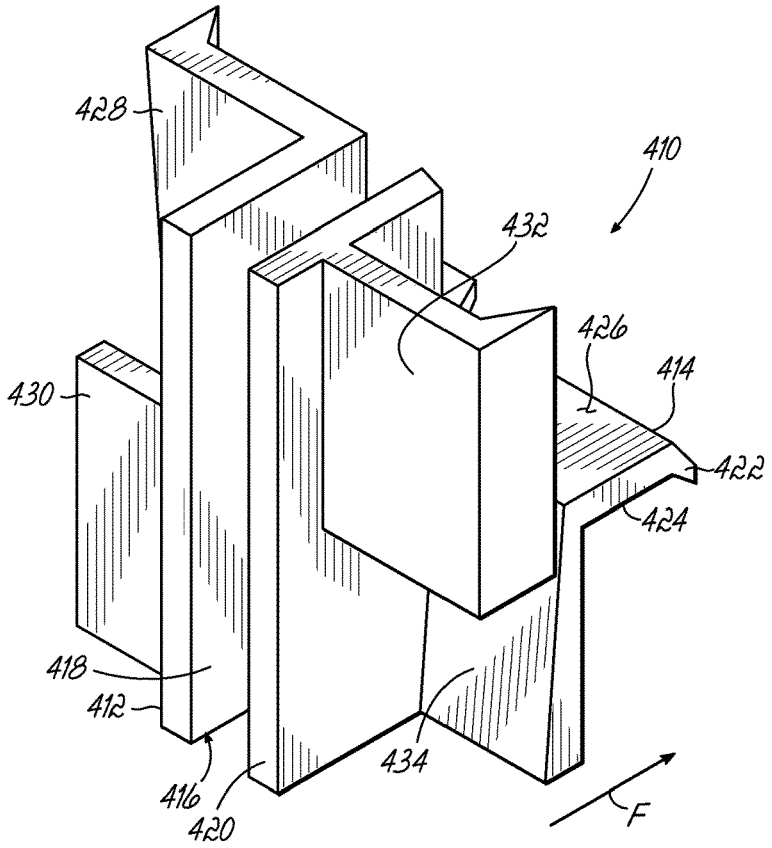
FIG. 14 is a front perspective view of a flow shifter baffle in accordance with yet another alternative embodiment, which specifically includes no structure extending across the double divider wall element.
Figure 15:
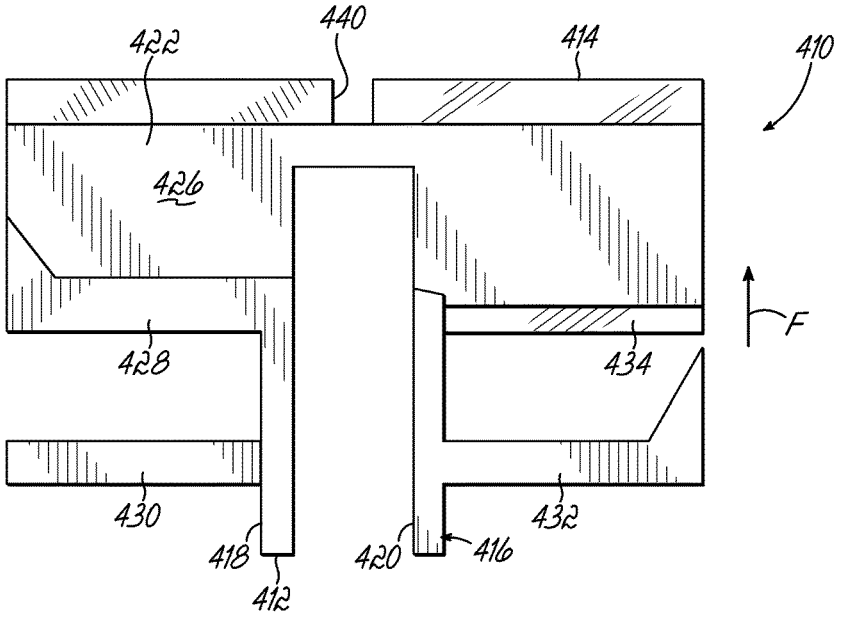
FIG. 15 is a top view of the flow shifter baffle of FIG. 14.
Figure 16:
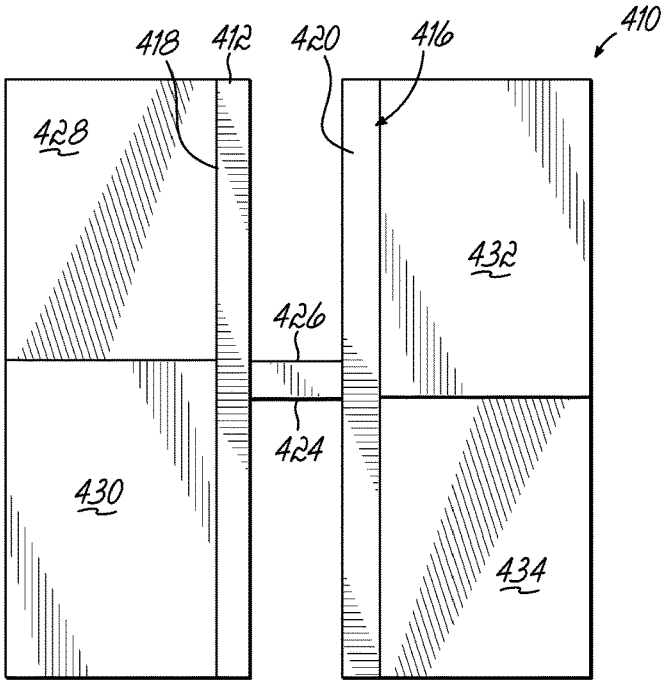
FIG. 16 is a front elevational view of the flow shifter baffle of FIG. 14.
Figure 17:
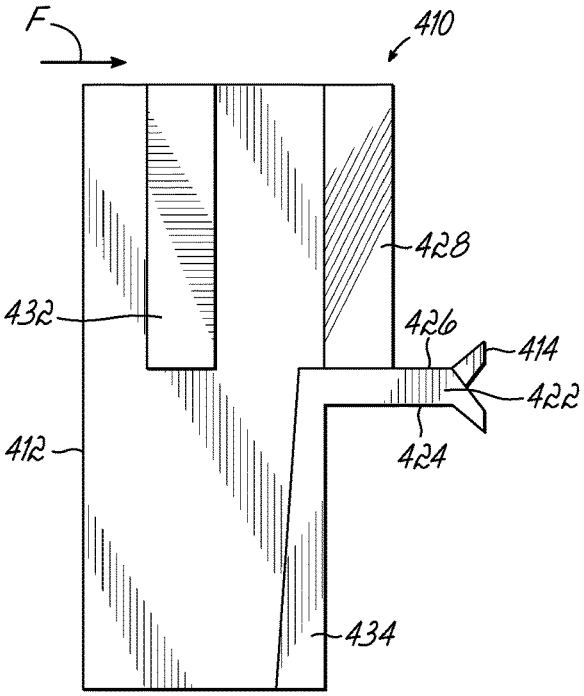
FIG. 17 is a side elevational view of the flow shifter baffle of FIG. 14.
Figure 18:
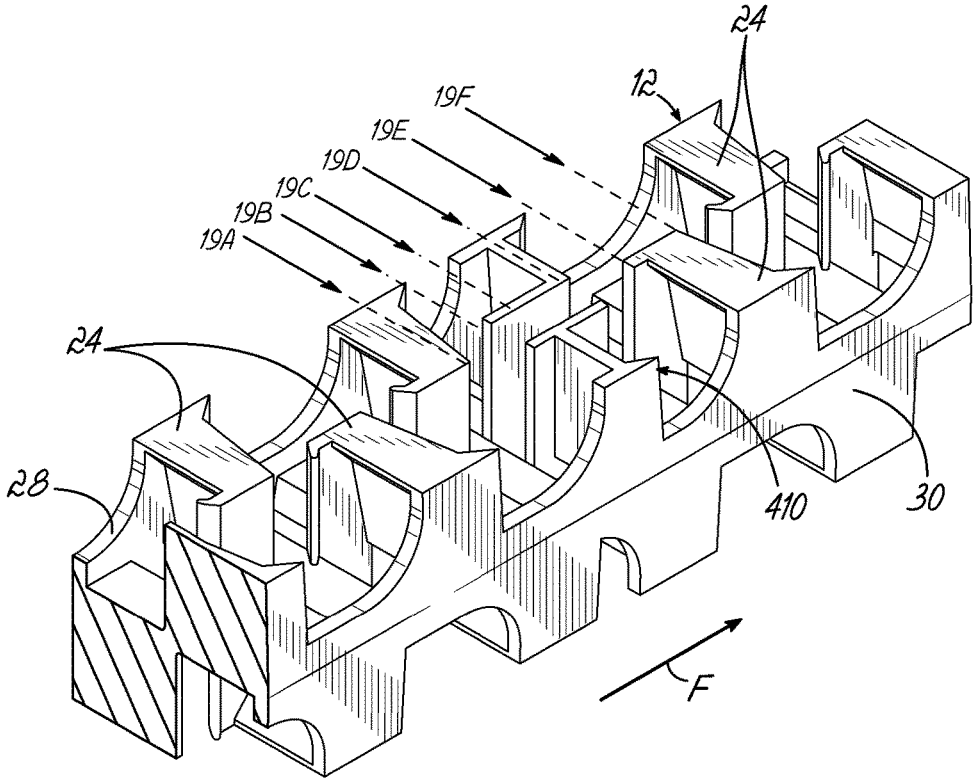
FIG. 18 is a front perspective view of a stack of mixing baffle elements including the flow shifter baffle of FIG. 14, with various flow cross sections indicated.

The first and second peripheral flow portions then flow along the first and second sides 324, 326 of the dividing panel 322, which forces one part of the central flow portion to be pushed leftwardly to an outer periphery of the static mixer 10 and another part of the central flow portion to be pushed rightwardly to an outer periphery of the static mixer 10. These central flow portions continue to be shown as separate in FIG. 13E to clarify this shifting movement. Thus, any flow streaks in the central flow portion are forced towards the outer periphery for further mixing downstream. FIG. 13E shows the flow at the junction of the trailing edge 314 of the flow shifter baffle 310 and the next mixing baffle element, which explains why the flow appears to be divided into quadrants. The first shift of this resulting flow by the downstream mixing baffle into two quadrants is shown in FIG. 13F, which is an analogous state as the original one shown in FIG. 13A before entering the flow shifter baffle 310. As can be readily understood from a comparison of FIGS. 13A and 13F, the doubling of the flow layers and general maintaining of the orientation of the flow layers is shown. Therefore, the flow shifter baffle 310 efficiently contributes to mixing of the two components while also moving any potential troubling flow streaks from a central portion to an outer periphery, where further mixing can occur by the downstream mixing baffles or elements.

As with the previous embodiment, the flow shifter baffle 310 divides a central flow portion from peripheral flow portions, and then moves or shifts these flow portions such that the orientation of any flow layers is not disturbed or jumbled by the shifting, but any potential flow streaks in the central flow portion are moved to an outer periphery of the static mixer 10 for further mixing at subsequent elements. Because the flow shifter baffle 310 minimizes the shifting movement applied to each flow portion, the added back-pressure caused by flowing through the flow shifter baffle 310 is reduced compared to conventional flow inverter designs. Thus, the flow shifter baffle 310 more efficiently handles the flow streaking phenomenon while avoiding a need to dramatically increase the length and/or the back-pressure generated within the static mixer 10. Furthermore, it will be appreciated that this embodiment of the flow shifter baffle 310 can be used with any type of other mixing baffle elements to achieve these functional benefits in the use of a static mixer 10, and this is not limited to the double wedge mixing baffles described in further detail above.

With reference to FIGS. 14 through 19F, another embodiment of a flow shifter baffle 410 in accordance with this invention is shown in detail. This flow shifter baffle 410 includes many of the same elements as the previously described embodiments (flow shifter baffles 210, 310), and these elements have been provided with similar reference numbers in the 400 series where the elements are substantially similar or identical. For example, the flow shifter baffle 410 of this embodiment again includes a leading edge 412, a trailing edge 414, a double divider wall element 416 defined by first and second parallel walls 418, 420, a dividing panel 422 with first and second sides 424, 426, and a plurality of occluding walls 428, 430, 432, 434. Although many of these elements have slightly modified shapes or profiles in this embodiment, the flow shifter baffle 410 and its elements function as described above except where the differences are outlined in further detail below (the detailed description of these identical or substantially similar elements is largely not repeated herein for the sake of brevity). Therefore, much like the previous embodiment, the flow shifter baffle 410 moves any flow streaks away from a central portion of the static mixer 10 while also doubling and maintaining the general orientation of flow layers so that the layers are not jumbled or mixed together in a detrimental manner, and also with minimized additional backpressure caused by flow through the flow shifter baffle 410.

In this embodiment of the flow shifter baffle 410, the dividing panel 422 is not completely split into two portions by the opening 440, thereby making this more like the first flow shifter baffle embodiment. The trailing edge 414 includes fins or tapering so as to guide the fluid flow into the next mixing baffle element when flowing through the static mixer 10. As previously described above, it will be understood that this tapering or sharpening may be applied to elements along the leading edge 412 as well (as was shown in the first embodiment of the flow shifter baffle 210) or not at all in similar embodiments.

The other primary distinction for this embodiment of the flow shifter baffle 410 is the structure which encounters the central flow portion after the fluid flow is divided into the central flow portion and first and second peripheral flow portions by the double divider wall element 416. As shown, there are no walls or other structure extending between the first and second parallel walls 418, 420, such that the central flow portion does not shift between the first and second parallel walls 418, 420. To this end, the flow shifter baffle 410 does not include any structure extending between the first and second parallel walls 418, 420. Therefore, the central flow portion passes freely through the first part of the flow shifter baffle 410 before being recombined with the shifting first and second peripheral flow portions moving along the first and second sides 424, 426 of the dividing panel 422, similar to the shifting described above.

Figure 19A:
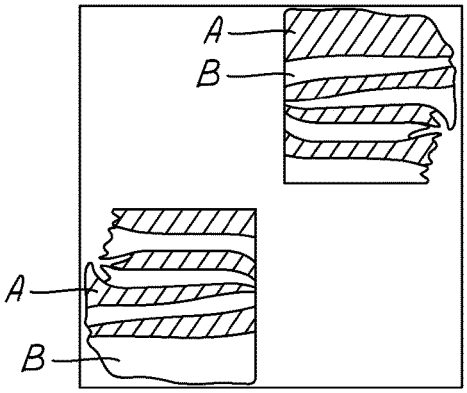
FIG. 19A is a flow cross section taken at line 19A shown in the view of FIG. 18.
Figure 19B:
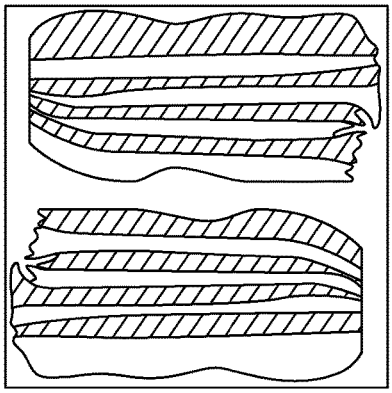
FIG. 19B is a flow cross section taken at line 19B shown in the view of FIG. 18.
Figure 19C:
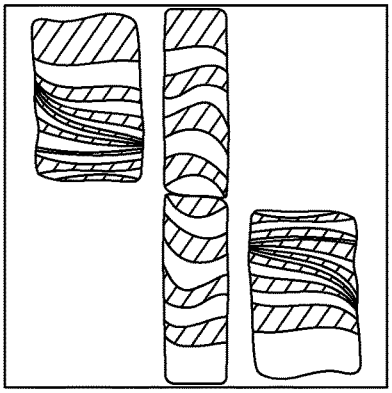
FIG. 19C is a flow cross section taken at line 19B shown in the view of FIG. 18.
Figure 19D:
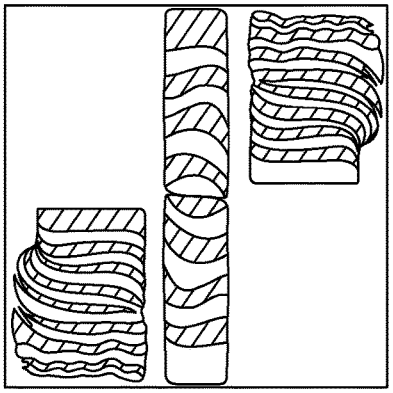
FIG. 19D is a flow cross section taken at line 19D shown in the view of FIG. 18.

FIGS. 18 and 19A through 19F schematically show a series of flow cross sections taken for a sample fluid flow having two components as evidenced by testing of the flow shifter baffle 410 of this embodiment and its associated static mixer 10. The specific locations of the flow cross sections relative to the flow shifter baffle 410 and the mixing baffles located immediately upstream and downstream from the flow shifter baffle 410 are indicated for clarity in FIG. 18. To this end, the flow is first shown in FIG. 19A while being shifted into two quadrants of the static mixer 10 by the double wedge mixing baffle located immediately upstream (in the fluid flow direction) from the flow shifter baffle 410. The fluid flow is defined by a number of layers of the two types of fluid, shown schematically by the different shading (A) or non-shading (B). FIG. 19B shows the fluid flow immediately before entry at the leading edge 412 of the flow shifter baffle 410, and it will be understood that the flow from each of the quadrants has spread or shifted to fill the space across the width of the static mixer 10.

After division by the double divider wall element 416, the fluid flow is shown in FIG. 19B passing through an initial portion of the flow shifter baffle 410. In this regard, the first peripheral flow portion (which includes parts of both flow portions shown in FIG. 19B) has been shifted upwardly by the occluding wall 430 and the second peripheral flow portion has been shifted downwardly by the occluding wall 432. The central flow portion is not shifted during flow between the first and second parallel walls 418, 420. This is also evident in the same view of the central flow section shown near the exit of the double divider wall element 416 in FIG. 19D. The first peripheral flow portion has been shifted downwardly by the occluding wall 428 while the second peripheral flow portion has been shifted upwardly by the occluding wall 434.

Figure 19E:
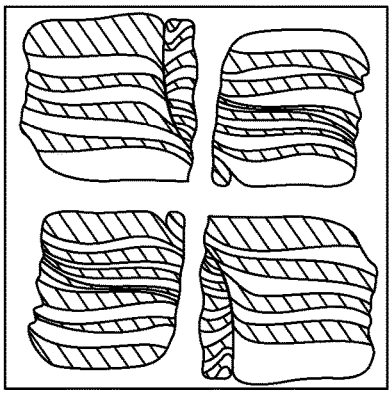
FIG. 19E is a flow cross section taken at line 19E shown in the view of FIG. 18.
Figure 19F:
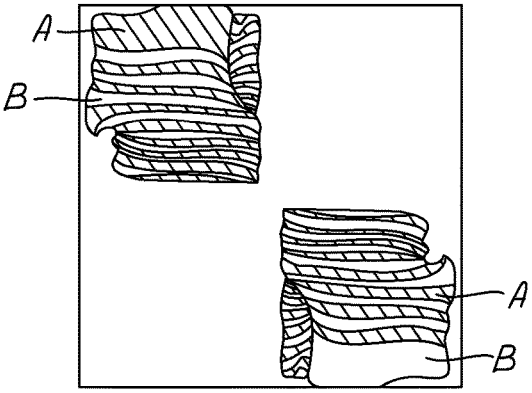
FIG. 19F is a flow cross section taken at line 19F shown in the view of FIG. 18.

The first and second peripheral flow portions then flow along the first and second sides 424, 426 of the dividing panel 422, which forces one part of the central flow portion to be pushed leftwardly to an outer periphery of the static mixer 10 and another part of the central flow portion to be pushed rightwardly to an outer periphery of the static mixer 10. These central flow portions continue to be shown as separate in FIG. 19E to clarify this shifting movement. Thus, any flow streaks in the central flow portion are forced towards the outer periphery for further mixing downstream. FIG. 19E shows the flow at the junction of the trailing edge 414 of the flow shifter baffle 410 and the next mixing baffle element, which explains why the flow appears to be divided into quadrants. The first shift of this resulting flow by the downstream mixing baffle into two quadrants is shown in FIG. 19F, which is an analogous state as the original one shown in FIG. 19A before entering the flow shifter baffle 410. As can be readily understood from a comparison of FIGS. 19A and 19F, the doubling of the flow layers and general maintaining of the orientation of the flow layers is shown. Therefore, the flow shifter baffle 410 efficiently contributes to mixing of the two components while also moving any potential troubling flow streaks to an area where further mixing can occur by the downstream mixing baffles or elements.

As with the previous embodiment, the flow shifter baffle 410 divides a central flow portion from peripheral flow portions, and then moves or shifts these flow portions such that the orientation of any flow layers is not disturbed or jumbled by the shifting, but any potential flow streaks in the central flow portion are moved to an outer periphery of the static mixer 10 for further mixing at subsequent elements. Because the flow shifter baffle 410 minimizes the shifting movement applied to each flow portion, the added back-pressure caused by flowing through the flow shifter baffle 410 is reduced compared to conventional flow inverter designs. Thus, the flow shifter baffle 410 more efficiently handles the flow streaking phenomenon while avoiding a need to dramatically increase the length and/or the back-pressure generated within the static mixer 10. Furthermore, it will be appreciated that this embodiment of the flow shifter baffle 410 can be used with any type of other mixing baffle elements to achieve these functional benefits in the use of a static mixer 10, and this is not limited to the double wedge mixing baffles described in further detail above.

Figure 20:
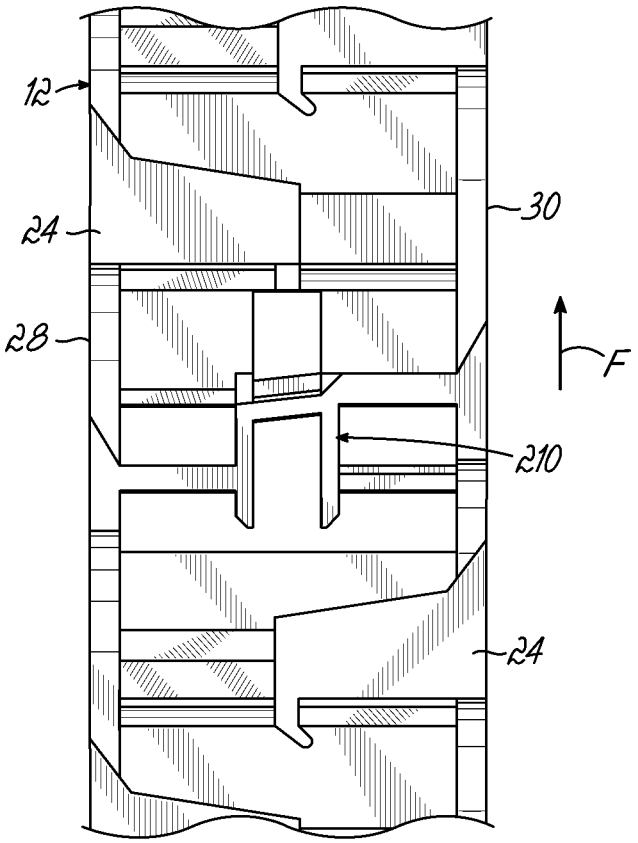
FIG. 20 is a top view of a stack of mixing baffle elements including a flow shifter baffle similar to that of FIG. 3.

FIG. 20 illustrates a series of mixing baffles or elements including double wedge baffles 24 and a flow shifter baffle 210 similar to the first embodiment described above. This Figure shows that several openings may be provided along the various dividing panels or surfaces of multiple baffles to provide the pressure equalization described in connection with the flow shifter baffles above.

Figure 21A:
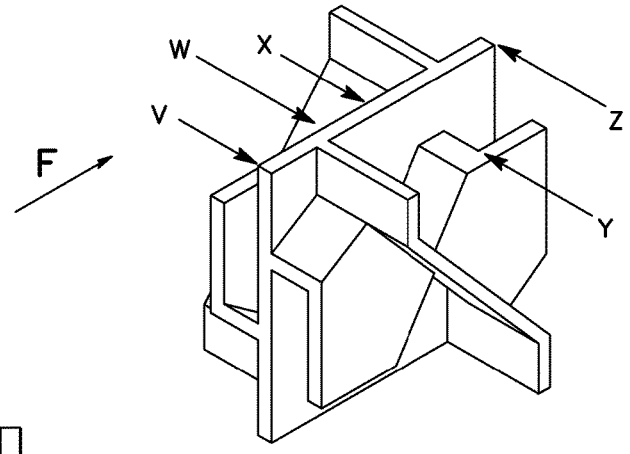
FIG. 21A PRIOR ART
FIG. 21A is a front perspective view of a prior art flow shifter baffle, with various flow cross sections indicated.
Figure 21B:
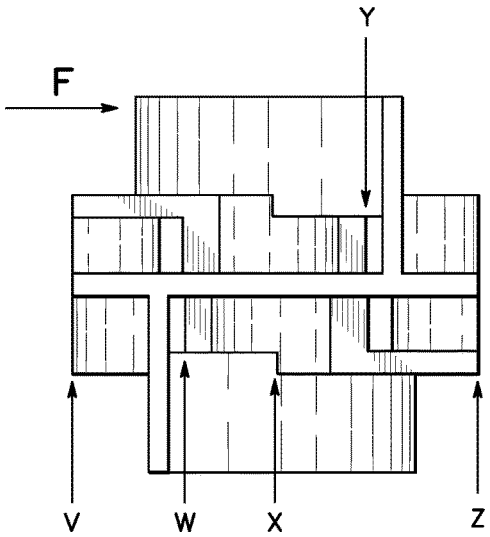
FIG. 21B PRIOR ART
FIG. 21B is a top view of the prior art flow shifter baffle of FIG. 21A.
Figure 21C:
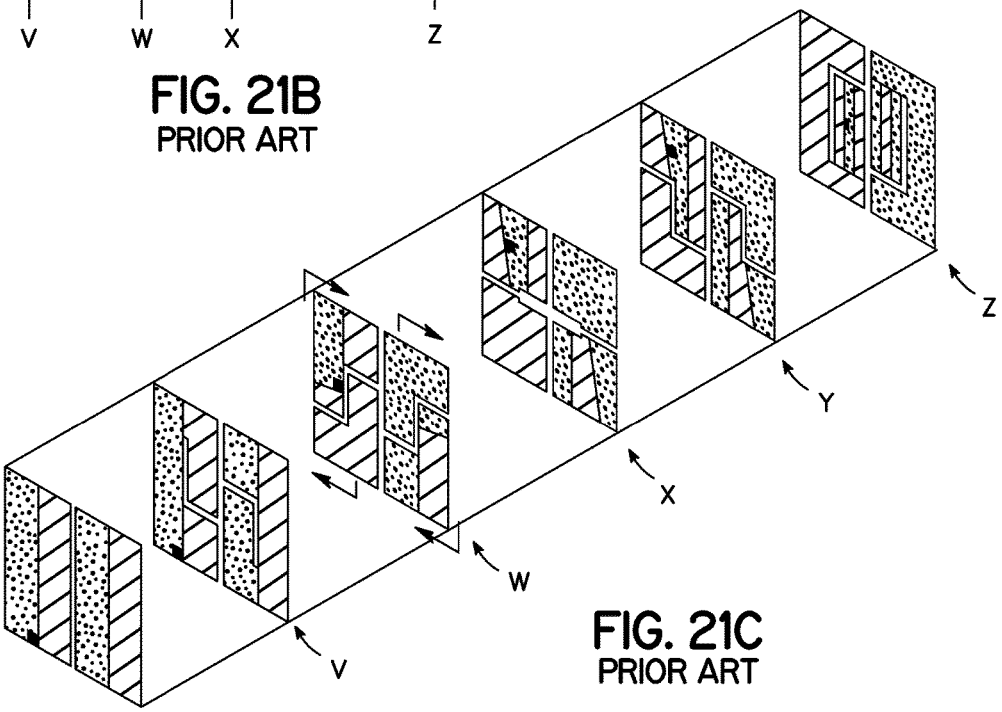
FIG. 21C PRIOR ART
FIG. 21C is a schematic view of the fluid flow cross-sections of the prior art flow shifter baffle of FIGS. 21A and 21B.

FIGS. 21A and 21B respectively show a front perspective view and a top view of a prior art flow inverter baffle as shown and described in U.S. Pat. No. 7,985,020 to Pappalardo, as previously referenced in the background section. FIGS. 21A and 21B each include reference cross-sections V, W, X, Y and Z from which the flow cross-sections of FIG. 21C are taken. As such, FIG. 21C is a schematic view of the fluid flow cross-sections of the prior art flow shifter baffle of FIGS. 21A and 21B.

Figure 22B:
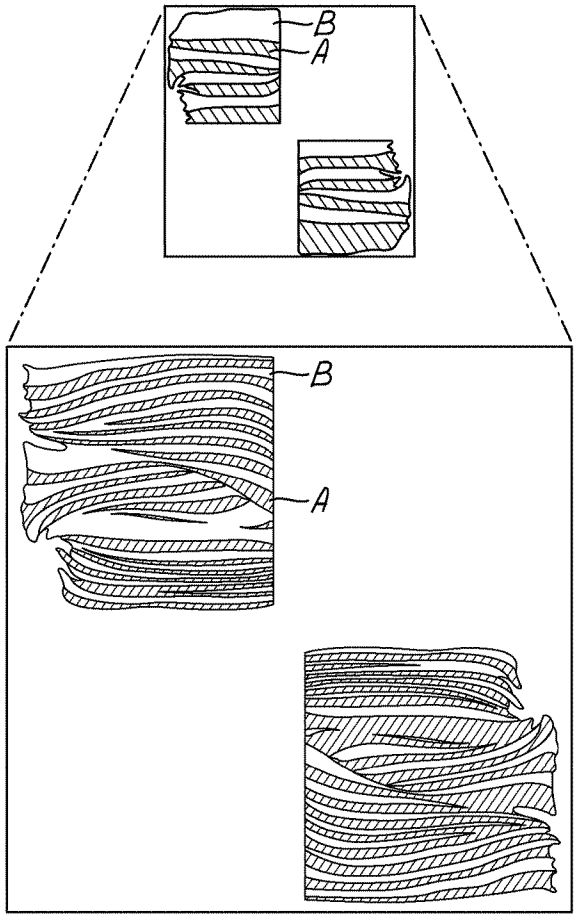
FIG. 22B is a schematic view showing fluid flow cross sections at the beginning of entry into the static mixer of the various embodiments described herein and after flowing through some of the mixing baffle elements, including one of the flow shifter baffles of FIGS. 3 through 20.
Figure 22A:
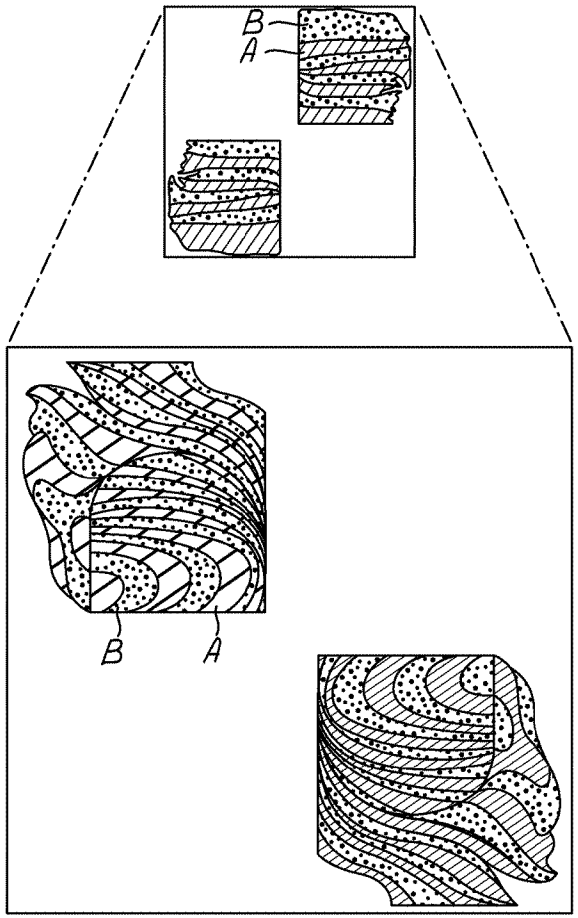
FIG. 22A PRIOR ART
FIG. 22A is a schematic view showing fluid flow cross sections at the beginning of entry into a prior art static mixer and after flowing through some of the mixing baffle elements of the prior art static mixer, including the flow shifter baffle of FIGS. 21A and 21B.

FIGS. 22A and 22B respectively show the side by side mixing results using a conventional static mixer (including one or more flow inverter baffles such as shown in FIGS. 21A and 21B) and the static mixer according to an aspect of the present invention. Specifically, FIG. 22B illustrates the mixing result achieved by the series of mixing baffles or elements in accordance with the embodiments of the static mixer 10. As can be seen, the flow layers of components A and B are thoroughly mixed and the flow layers are substantially maintained to ensure the high efficiency of this mixing action (e.g., no significant flow streaks are produced by jumbling together of the flow layers). As compared to FIG. 22A, FIG. 22B clearly shows less jumbling of the layers, as the layers of components A and B in FIG. 22B are generally parallel to one another resulting in greater mixing with less flow streaks of completely unmixed fluid in the extruded mixture. Further, as compared to FIG. 22A, FIG. 22B shows a far greater number of layers of components A and B caused by division and recombination. Greater division and recombination causes the layers of the fluids being mixed to thin and eventually diffuse past one another, eventually resulting in a generally homogenous mixture of the fluids (with a shorter necessary length of the mixer overall). Thus, the static mixer 10 achieves various functional benefits over conventional mixer designs as set forth in detail above.

While the present invention has been illustrated by a description of exemplary embodiments and while these embodiments have been described in some detail, it is not the intention of the Applicant to restrict or in any way limit the scope of the appended claims to such detail. Additional advantages and modifications will readily appear to those skilled in the art. The various features of the disclosure may be used alone or in any combination depending on the needs and preferences of the user. This has been a description of the present invention, along with the preferred methods of practicing the present invention as currently known. However, the invention itself should only be defined by the appended claims.

What is claimed is:

1. A flow shifter baffle for mixing a fluid flow having at least two fluid components, the flow shifter baffle comprising:

a leading edge and a trailing edge, the flow shifter baffle defining a transverse flow cross-section perpendicular to the fluid flow along an entire length between the leading and trailing edges and an axis perpendicular to and centered with respect to the transverse flow cross-section, with the transverse flow cross-section having an outer periphery;

a double divider wall element adjacent to the leading edge, the double divider wall element including first and second generally parallel walls that extend across an entirety of the transverse flow cross-section and define a central opening from the first wall to the second wall at the leading edge such that the axis extends through the central opening, wherein the double divider wall element is configured to divide the fluid flow into a central flow portion that flows through the central opening and first and second peripheral flow portions;

a plurality of occluding walls coupled to the double divider wall element and positioned to force movement of the first and second peripheral flow portions; and a dividing panel adjacent to the trailing edge and extending substantially perpendicular to the transverse flow cross-section, the dividing panel defining a first side, a second side opposite the first side, and an opening extending therethrough from the first side to the second side.

2. The flow shifter baffle of claim 1 wherein the dividing panel is coupled to the double divider wall element, and the first and second sides face opposite directions and are oriented transverse from the first and second generally parallel walls, wherein the plurality of occluding walls force the first peripheral flow portion to flow along the first side of the dividing panel and the second peripheral flow portion to flow along the second side of the dividing panel, thereby shifting the central flow portion towards an outer periphery of the flow shifter baffle as the first and second peripheral flow portions flow along the first and second sides of the dividing panel respectively.

3. The flow shifter baffle of claim 2, wherein the plurality of occluding walls further comprise first, second, third, and fourth occluding walls, wherein the first occluding wall located in a lower left quadrant forces the first peripheral flow portion to shift upwardly, and the second occluding wall located in an upper left quadrant forces the first peripheral flow portion to shift downwardly along the first side of the dividing panel, and wherein the third occluding wall located on an upper right quadrant forces the first peripheral flow portion to shift downwardly, and the fourth occluding wall located in a lower right quadrant forces the second peripheral flow portion to shift upwardly along the second side of the dividing panel.

4. The flow shifter baffle of claim 1, wherein the double divider wall element further comprises a first central occluding wall surface located along an upper portion of space defined between the first and second parallel walls.

5. The flow shifter baffle of claim 4, wherein the first central occluding wall surface is angled with respect to the transverse flow cross-section.

6. The flow shifter baffle of claim 4, wherein the double divider wall element further comprises a second central occluding wall surface integrally formed to one of the plurality of occluding walls.

7. The flow shifter baffle of claim 6, wherein the first and second central occluding wall surfaces do not overlap.

8. The flow shifter baffle of claim 1, wherein the first and second generally parallel walls include a tapered or sharpened end at the leading edge to help reduce backpressure and guide the fluid flow into spaces around the double divider wall element.

9. The flow shifter baffle of claim 1, further comprising:

a central X-shaped structure extending between the first and second parallel walls and including first and second angled walls, the first angled wall extending from the first parallel wall at the leading edge to a back end of the second parallel wall and the second angled wall extending from the second parallel wall at the leading edge to a back end of the first parallel wall.

10. The flow shifter baffle of claim 9, wherein the first angled wall is located at a top portion of the transverse flow cross-section of the flow shifter baffle, while the second angled wall is located at a bottom portion of the transverse flow cross-section of the flow shifter baffle.

11. The flow shifter baffle of claim 1, wherein there are no walls or other structure extending between the first and second parallel walls, such that the central flow portion does not shift between the first and second parallel walls.

12. The flow shifter baffle of claim 1, wherein each of the plurality of occluding walls is substantially parallel to the transverse flow cross-section.

13. The flow shifter baffle of claim 1, further comprising:

a central occluding wall positioned between the first and second walls of the double divider wall element, wherein the central occluding wall defines an opening extending therethrough such that the axis extends through the opening and the opening is configured to receive the central flow portion.

14. A static mixer for mixing a fluid flow having at least two fluid components, the static mixer comprising:

a mixer conduit configured to receive the fluid flow; and a mixing component defined by a plurality of mixing elements positioned in the mixer conduit, the plurality of mixing elements including at least one flow shifter baffle according to claim 1.

15. The static mixer of claim 14, wherein the plurality of mixing elements are configured to mix the at least two fluid components.

* * * * *